United States Patent [19]

Davis et al.

[11] 4,447,188

[45] May 8, 1984

[54] COOLED TURBINE WHEEL

[75] Inventors: Arthur M. Davis, Wixom; Warren J. Pollington, Southfield, both of Mich.

[73] Assignee: Williams International Corporation, Walled Lake, Mich.

[21] Appl. No.: 372,914

[22] Filed: Apr. 29, 1982

[51] Int. Cl.[3] ..... F01D 5/08

[52] U.S. Cl. ..... 415/115; 416/97 R; 416/244 A

[58] Field of Search ..... 416/95, 96 A, 97 R, 416/244 A; 415/115

[56] References Cited

U.S. PATENT DOCUMENTS

| | | | |
|---|---|---|---|
| 3,609,059 | 9/1971 | Wagle | 416/95 |
| 3,635,586 | 1/1972 | Kent et al. | 416/95 |
| 3,749,514 | 7/1973 | Kelch et al. | 416/213 UX |
| 3,982,852 | 9/1976 | Andersen et al. | 416/95 |
| 4,102,603 | 7/1978 | Smith et al. | 416/95 X |

FOREIGN PATENT DOCUMENTS

| | | | |
|---|---|---|---|
| 991773 | 10/1951 | France | 416/244 A |
| 1432875 | 4/1976 | United Kingdom | 416/95 |

*Primary Examiner*—Stephen Marcus
*Assistant Examiner*—Joseph M. Pitko
*Attorney, Agent, or Firm*—Lyman R. Lyon

[57] ABSTRACT

A unitary turbine wheel for a gas turbine engine, the turbine wheel including a pair of initially separate discs which are diffusion bonded together and define air passageways which extend radially through the discs. A plurality of initially separate turbine blades are provided each of which defines cooling air passageways, and the turbine blades are diffusion bonded in angularly spaced relationship to the peripheral surfaces of the discs with the air passageways in the blades communicating with the air passageways defined by the discs. Means is provided for drivably connecting the turbine wheel to a turbine shaft, and in a preferred embodiment, the turbine blades have a thermally insulating coating on the exposed surfaces thereof.

2 Claims, 6 Drawing Figures

32
18
24
99
81
6
12
40
98
96
42
54
56
10
74
72
70
68
94
38
76
34
64
52
50
97
28
100
102
30
36
22
108
26
106
104

32
81
4
4
54
86
98
46
82
84
40
60
5
56
42
74
72
70
68
34
88
58
44
90
38
76
66
64
52
36
48
28
30
62
50
108
106
5

COOLED TURBINE WHEEL

The U.S. Government has a paid-up license in this invention and the right in limited circumstances to require the patent owner to license others on reasonable terms as provided for by the terms of contract No. DAAK30-79-C-0092 awarded by the Department of the Army, U.S. Tank-Automotive Command.

BRIEF SUMMARY OF THE INVENTION

This invention relates to turbine wheels for gas turbine engines and, more particularly, to an improved, cooled turbine wheel for gas turbine engines.

As is well known in the art, the turbine wheels of gas turbine engines are subjected to the high temperatures of the products of combustion emanating from the combustion chambers of the gas turbine engines, and the turbine wheels are also subjected to high, thermally induced stresses as well as dynamic stresses during operation of the gas turbine engines. It is well known in the art that in gas turbine engines it is desirable to cool the turbine wheels, and that it is desirable to reduce the thermal and dynamic stresses as much as possible. Heretofore, the metal turbine blades have been coated with various overlay coatings so as to provide a thermal barrier for the base metal, and efforts have also been made to cool the turbine wheels and blades carried thereby, but such efforts have tended to increase the weight and complexity of the turbine wheels as well as the operating dynamic stresses.

An object of the present invention is to overcome disadvantages in prior turbine wheels for gas turbine engines and to provide an improved turbine wheel for gas turbine engines incorporating improved means for cooling the turbine wheel including the turbine blades embodied thereon.

Another object of the present invention is to provide an improved turbine wheel comprised of a plurality of initially separate components which are joined together by diffusion bonding to form a unitary structure.

Another object of the present invention is to provide an improved turbine wheel for gas turbine engines incorporating improved cooling air passageways to the turbine blade roots.

Another object of the present invention is to provide an improved turbine wheel for gas turbine engines in which the materials for the turbine blades and associated supporting discs may be individually optimized to meet the particular requirements of such components.

Another object of the present invention is to provide an improved turbine wheel for gas turbine engines incorporating improved means for enhancing the cooling effectiveness of the cooling air.

Another object of the present invention is to provide an improved turbine wheel for gas turbine engines which is subject to lower disc stresses and has better stress distribution than prior turbine wheels.

Another object of the present invention is to provide an improved turbine wheel for gas turbine engines that is economical and commercially feasible to manufacture, assemble and test, durable, efficient and reliable in operation.

Another object of the present invention is to provide an improved turbine wheel for gas turbine engines wherein the component parts are diffusion bonded into a permanent unitary structure with sufficiently strong joints to withstand the high stresses encountered in a gas turbine engine turbine wheel.

Another object of the present invention is to provide an improved turbine wheel for gas turbine engines which provides an excellent flow path for the cooling air, which permits use of turbine blade designs having unusually good access to the cooling air passageways, and which greatly simplifies the problem of supporting the cooling passage cores when the blades are cast.

Another object of the present invention is to provide an improved turbine wheel for gas turbine engines wherein the dead weight is reduced to a minimum.

The above as well as other objects and advantages of the present invention will become apparent from the following description, the appended claims and the accompanying drawings.

DETAILED DESCRIPTION

Figure 1:
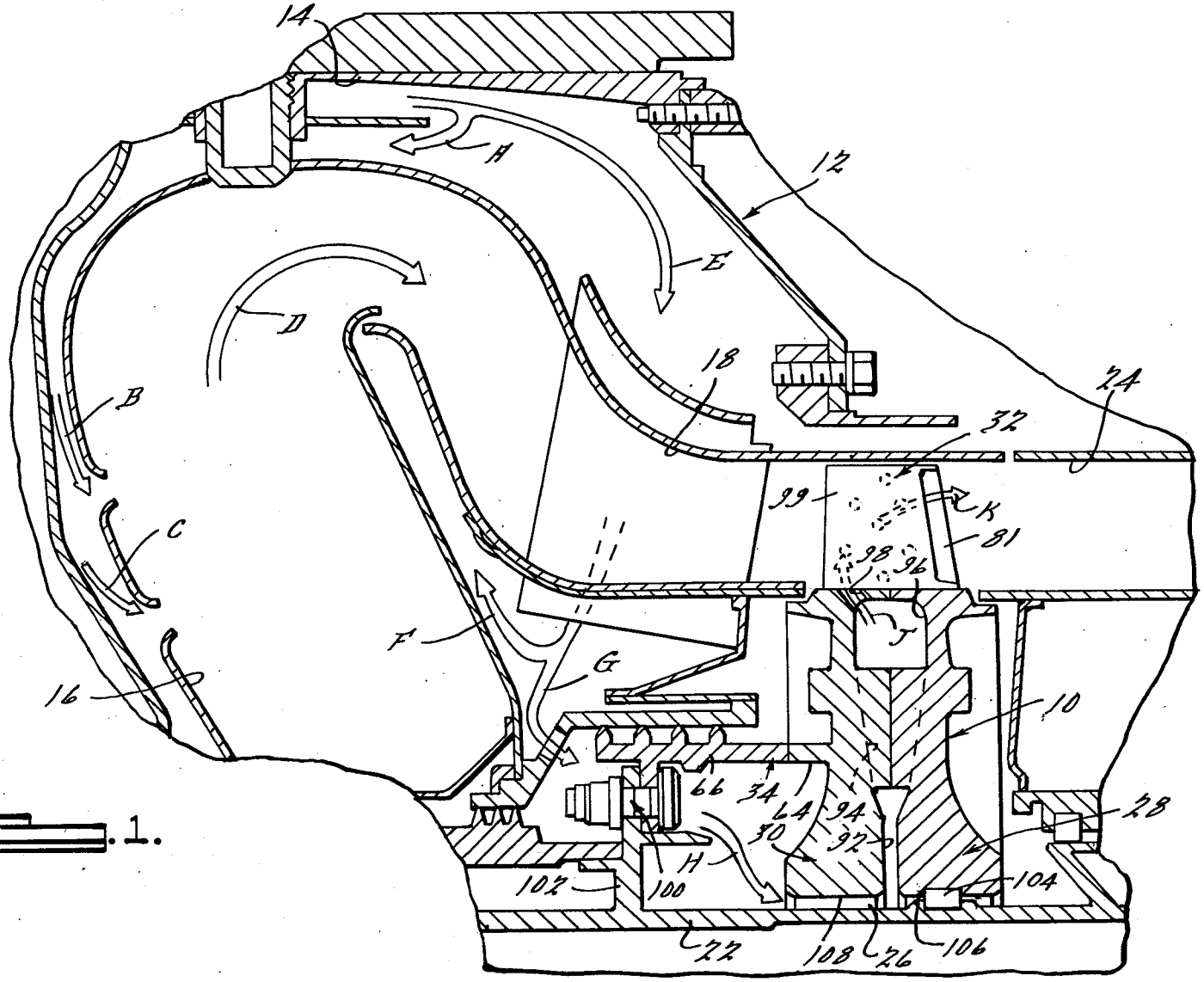
FIG. 1 is a cross sectional view of a cooled turbine wheel embodying the present invention, showing the same in assembled relationship with adjacent parts of a partially illustrated gas turbine engine.

Referring to the drawings, a cooled turbine wheel, generally designated 10, is illustrated embodying the present invention, the turbine wheel 10 having particular utility in gas turbine engines. In FIG. 1 of the drawings, the adjacent components of a typical gas turbine engine, generally designated 12, are also illustrated, these adjacent components being of conventional construction and their use being so well known in the art that a detailed description thereof is not required for a full understanding of the invention. In gas turbine engines, the inlet air flow to the engine is compressed by a compressor (not shown), and pressurized air is discharged from the compressor through a discharge conduit 14. A portion of the pressurized air emanating from the conduit 14, indicated by the arrows A, B and C, is directed into a combustion chamber 16 where the pressurized air is mixed with fuel injected into the combustion chamber, the high pressure air and fuel mixture being ignited in the combustion chamber to produce the high energy, high temperature products of combustion, indicated by the arrow D, which exit from the combustion chamber through a nozzle 18. The high energy, high temperature products of combustion impinge upon the turbine blades 32 of the turbine wheel 10 which embodies the present invention, as will be described hereinafter in greater detail, and the high temperature, high energy products of combustion drive the turbine wheel 10 which, in turn, is connected to and drives a turbine shaft 22. The products of combustion are then exhausted through an outlet 24.

Additional pressurized air, indicated by the arrows E and F, emanating from the conduit 14 is utilized as cooling air and directed over the outer surfaces of the combustion chamber, the nozzle, and other components of the engine which are heated by the products of combustion, and pressurized cooling air, indicated by the arrows G and H, is also directed to the central or hub section 26 of the turbine wheel 10 which is disposed at a position near, but spaced from, the turbine shaft 22.

In accordance with the present invention, the turbine wheel 10 is comprised of a pair of initially separate discs 28 and 30, a plurality of the individual, initially separate, angularly spaced turbine blades 32, and an initially separate rotor support 34. The disc 28 includes a hub portion 36, a relatively thin intermediate portion 38 formed integrally with and disposed radially outwardly of the hub portion 36, and a rim portion 40 formed integrally with and disposed radially outwardly of the intermediate portion 38. In addition, the disc 28 includes a plurality of angularly spaced, radially extending rib portions 42 which are formed integrally with and project axially outwardly from the inner side of the intermediate portion 38 of the disc 28 toward the disc 30. As shown in the drawings, in accordance with the present invention, the radially extending edges 44 of the angularly spaced rib portions 42, and the radially extending edge 46 of the rim portion 40 are disposed in coplanar relationship and in axially spaced relationship with respect to the radially extending edge 48 of the hub portion 36.

The disc 30 also includes a hub portion 50, a relatively thin intermediate portion 52 formed integrally with and disposed radially outwardly of the hub portion 50, and a rim portion 54 formed integrally with and disposed radially outwardly of the intermediate portion 52. The disc 30 also includes a plurality of angularly spaced radially extending rib portions 56 which are formed integrally with and project axially outwardly from one side of the intermediate portion 52 of the disc 30 toward and in aligned relationship with respect to the angularly spaced radially extending ribs 42 provided on the disc 28. In accordance with the present invention, the radially extending edges 58 of the angularly spaced rib portions 56 and the radially extending edge 60 of the rim portion 54 are disposed in coplanar relationship and in axially spaced relationship with respect to the radially extending edge 62 of the hub portion 50 of the disc 30. In addition, the disc 30 includes an integral flange portion 64 which projects axially outwardly from the intermediate portion 52 of the disc 30 from the side thereof opposite the angularly disposed ribs 56 formed thereon.

Figure 2:
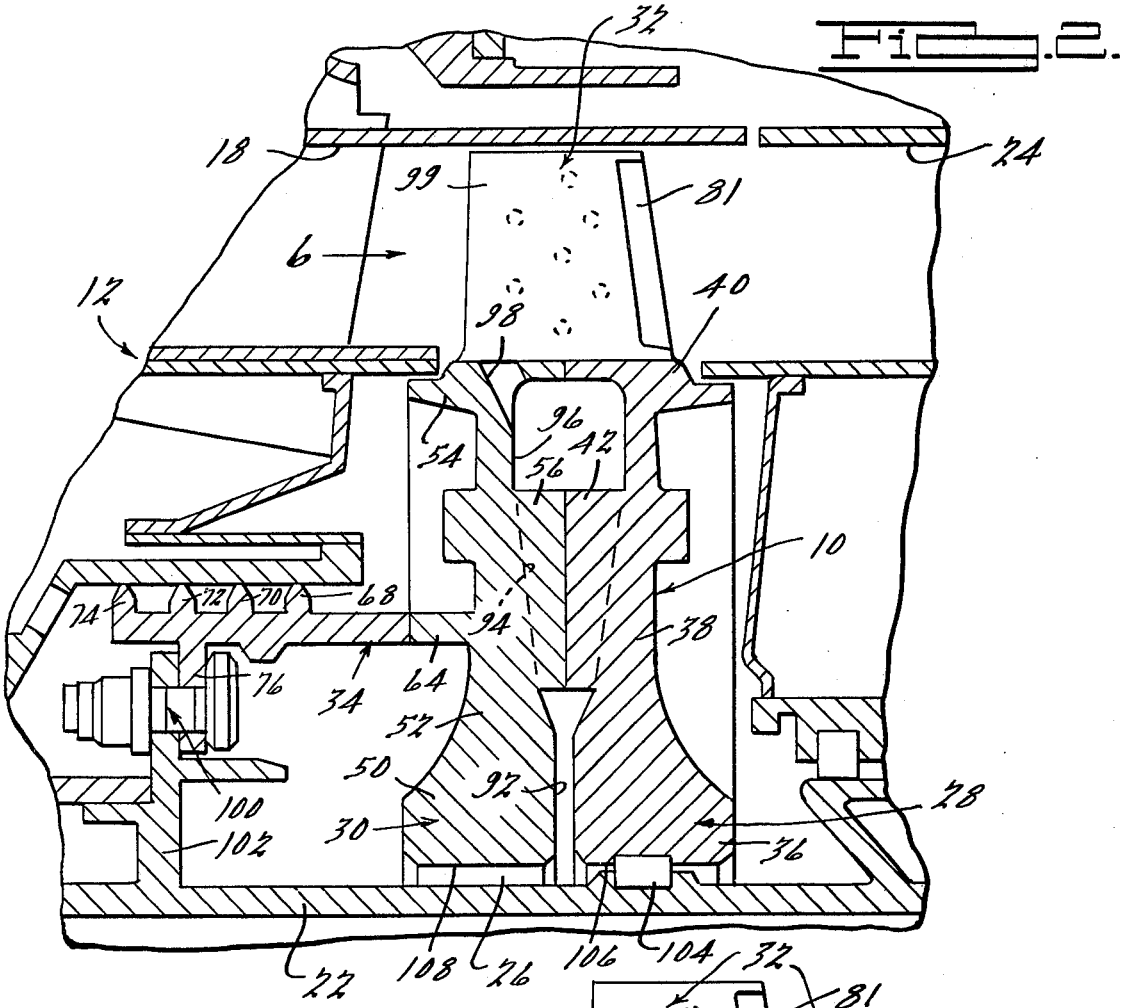
FIG. 2 is an enlarged view of the turbine wheel illustrated in FIG. 1.
Figure 3:
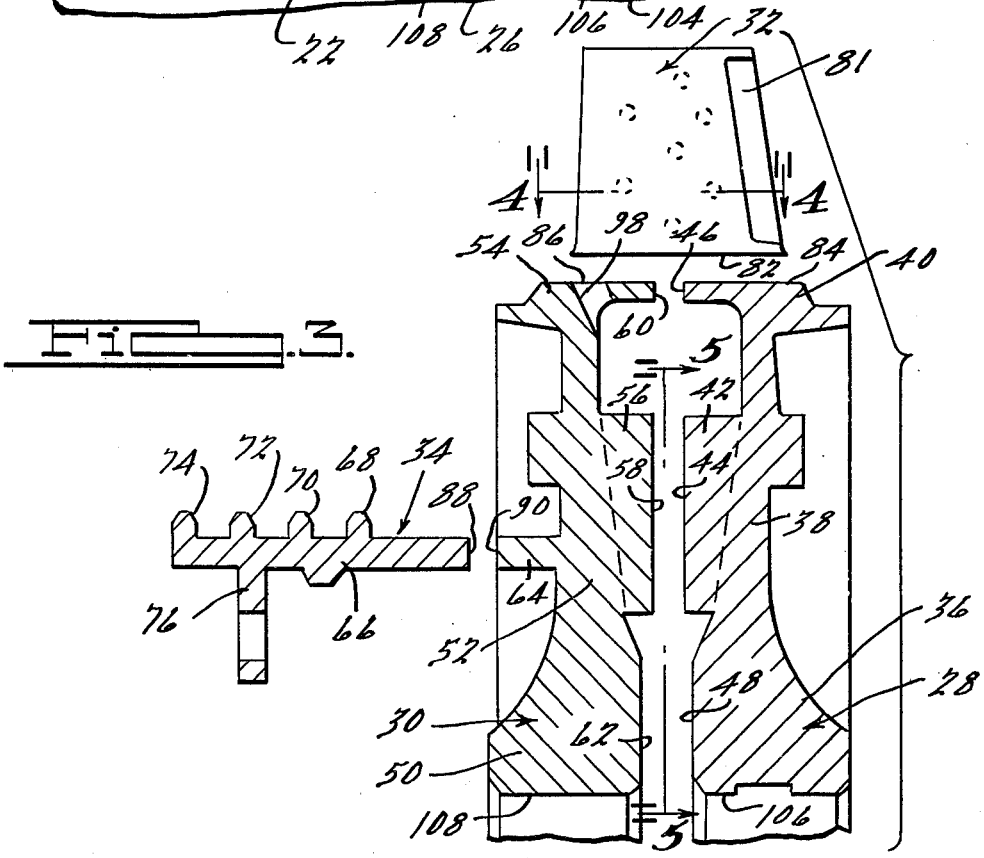
FIG. 3 is an exploded view of the turbine wheel illustrated in FIGS. 1 and 2 and showing the components thereof prior to the final assembly thereof.
Figure 4:
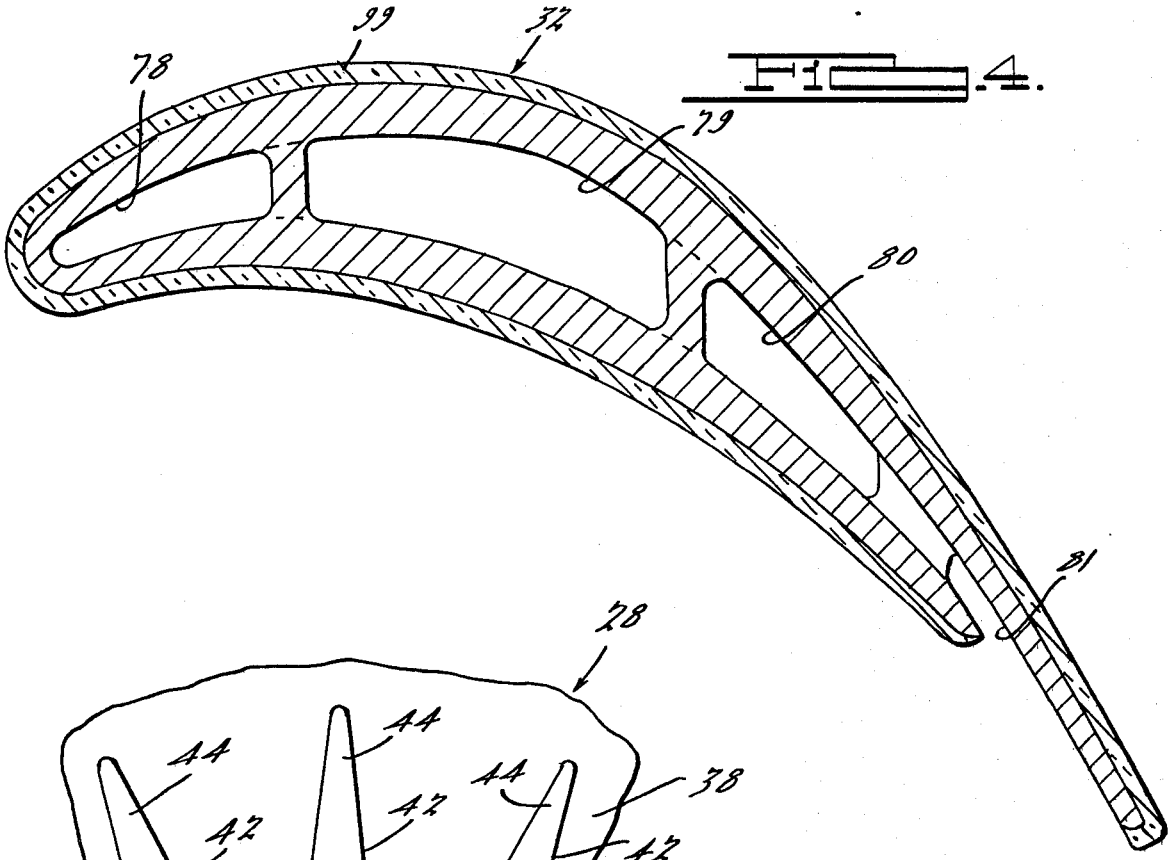
FIG. 4 is a cross sectional view of a portion of the structure illustrated in FIG. 3, taken on the line 4—4 thereof.
Figure 5:
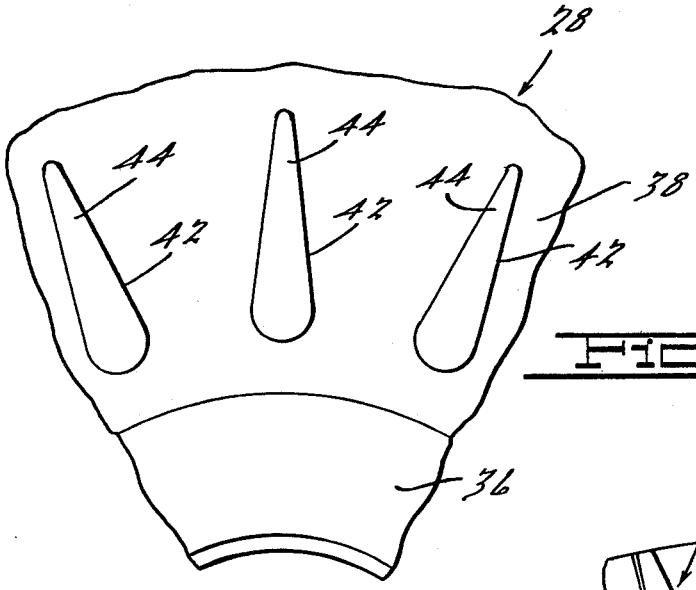
FIG. 5 is an elevational view of a portion of the structure illustrated in FIG. 3, taken on the line 5—5 thereof.
Figure 6:
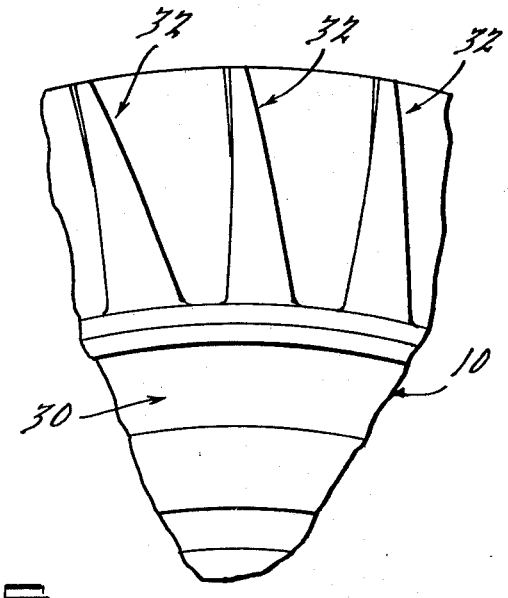
FIG. 6 is an elevational view of a portion of the structure illustrated in FIG. 1 and looking in the direction of the arrow 6.

As shown in the drawings, the initially separate rotor support 34 includes a generally tubular body portion 66 having a plurality of integral, longitudinally spaced sealing ribs 68, 70, 72 and 74 projecting radially outwardly therefrom and an integral flange portion 76 projecting radially inwardly from the central section thereof, the flange portion 76 facilitating attachment of the turbine wheel 10 to the turbine shaft 22 as illustrated in FIGS. 1 and 2.

The individual, initially separate, angularly spaced turbine blades 32 (there may be, for example, forty such blades on the turbine wheel 10) are each provided with cooling passages, such as 78, 79, 80 and 81, through which cooling air flows to cool the blades as will be described hereinafter in greater detail. In accordance with the present invention, the confronting edges 44 and 58 of the angularly spaced rib portions 42 and 56, respectively, and the confronting edges 46 and 60 of the rim portions 40 and 54, respectively, of the discs are bonded together by activated diffusion bonding to form a unitary structure. In addition, the blade root surfaces 82 of the turbine blades 32 are diffusion bonded to the peripheral surfaces 84 and 86 of the rim portions 40 and 54, respectively, of the discs. Moreover, the confronting surfaces 88 and 90 of the rotor support 34 and the flange 64, respectively, are also diffusion bonded together whereby the discs 28 and 30, the turbine blades 32, and the rotor support 34 are permanently joined together to form a unitary structure. Since the radially extending edges 44 and 58 of the angularly spaced rib portions 42 and 56, and the radially extending edges 46 and 60 of the rim portions 40 and 54 of the discs, are diffusion bonded together while the edges 48 and 62 of the hub portions 36 and 50, respectively, are disposed in spaced relationship with respect to each other, such a construction provides communicating cooling air passageways 92, 94 and 96 from the radially inner or hub portion of the turbine wheel to the turbine blade roots, the rim portion 54 of the disc 30 being provided with passageways 98 connecting the air passageway or chamber 96 with the cooling passages, such as 78, 79, 80 and 81 provided in the turbine blade 32.

The exposed surfaces of the turbine blades are also preferably coated with a ceramic coating 99 which acts as a thermal barrier or insulation on the blades to reduce the metal temperature during operation of the turbine. Such thermal barrier coating may, for example, be of the type disclosed in U.S. Pat. No. 4,055,705, although it will be understood that other types of thermal barrier coatings may be utilized.

The unitary turbine wheel 10 with all of the components thereof diffusion bonded together as previously described, is assembled in the gas turbine engine as illustrated in FIGS. 1 and 2, the flange portion 76 of the rotor support 34 being fixed as at 100 to a flange 102 provided on the turbine shaft 22 so as to connect the turbine wheel 10 in driving engagement with the turbine shaft 22. As previously mentioned, pressurized cooling air emanating from the conduit 14 is directed to the radially inner or hub section 26 of the turbine wheel 10, as indicated by the arrows G and H, and such cooling air flows from the hub section 26 of the turbine wheel 10, as indicated by the arrow J, through the previously described cooling air passages 92, 94 and 96 defined by the diffusion bonded discs 28 and 30, and through the passages 98 in the rim portion of the turbine wheel to the roots of the turbine blades 32 and through and out of the air passages, such as 78, 79, 80 and 81, provided in the turbine blades, as indicated by the arrow K, where such cooling air mixes and is entrained with the products of combustion impinging upon the turbine blades. A suitable sealing ring 104 is provided adjacent the radially inner surface portion 106 of the disc 28 so that cooling air entering into the space defined between the radially inner surface portion 108 of the disc 30 and the turbine shaft 22 is directed radially outwardly through the cooling air passage 92 defined by the turbine wheel.

With the applicants' novel construction, wherein two disc elements and a multiplicity of individual turbine blades are all joined together by activated diffusion bonding, the double disc construction provides convenient cooling air passageways to the blade roots, and the use of two discs permits close control and inspection of the cooling air passageways. The cooling air entrance into the blade roots provides exceptionally good support for the air passage cores in the blades, and the use of initially separate blades and discs permits the material from which each is made to be optimized for the particular requirements of the turbine blades and the discs. Moreover, the thermal coating on the blades makes the cooling much more effective for any given flow of cooling air.

The dual disc turbine wheel embodying the present invention is subject to lower disc stresses and has better stress distribution than prior art arrangements, and in particular, the present invention provides exceptionally low and uniform rim stresses which can be varied to meet individual design requirements by proper proportioning of disc geometry and directional control of cooling air flow. The initially separate and diffusion bonded turbine blade construction is extremely simple because it makes best use of the proven reliability and uniformly high strength properties of the activated diffusion bonding process. Intimate contact of mating surfaces is a primary requirement for successful diffusion bonding, and this is provided by the novel blade attachment means which employs the contact of matching convex and concave cylindrical surfaces on the disc rim and blade roots, respectively. The surfaces can be readily produced with an extremely high order of accuracy using conventional manufacturing techniques.

The use of diffusion bonding to join the initially separate components of the turbine wheel into a permanent unitary structure provides sufficiently strong joints able to withstand the high stresses which occur in a turbine wheel, and the employment of a direct tensile load path across the bonded joint at the blade roots permits the core passages in the blades to be completely open for direct visual inspection and accurate and rigid core positioning. These features are especially important for the reliable and economical manufacture of small high performance gas turbine engines. It will be noted that the applicants' novel construction also eliminates extended blade root platforms and simplifies blade casting. It should be understood that portions of platforms remote from the blade walls contribute nothing to the load carrying ability of the bonded joints and simply add dead weight to the turbine wheel.

It will also be understood that while the preferred embodiment of the invention illustrated and described herein utilizes a ceramic thermal barrier coating on the turbine blades as a means for reducing the amount of required cooling air, in some engine applications the use of uncoated turbine blades may be justified if the amount of cooling air required does not degrade the thermodynamic cycle to an unacceptable extent.

While a preferred embodiment of the invention has been illustrated and described, it will be understood that various changes and modifications may be made without departing from the spirit of the invention. For example other bonding processes may be utilized to bond the initially separate components of the turbine wheel to form a unitary structure.

What is claimed is:

1. A unitary turbine wheel for a gas turbine engine having a turbine shaft, said turbine wheel comprising, in combination, a pair of initially separate discs, a plurality of initially separate turbine blades, and an initially separate rotor support, each of said discs including a hub portion having side portions, respectively, a relatively thin intermediate portion formed integrally with and disposed radially outwardly of said hub portion and having a maximum axial dimension less than the maximum axial dimension of said hub portion, and a rim portion formed integrally with and disposed radially outwardly of said intermediate portion and having a maximum axial dimension greater than the maximum axial dimension of said intermediate portion, each of said discs also including a plurality of angularly spaced, radially extending rib portions formed integrally with and projecting axially from the intermediate portions of said discs, radially extending edge portions of said rib portions and radially extending edge portions of said rim portions of said discs being radially aligned and disposed in axially spaced relationship with respect to the radially extending side portions of said hub portions of said discs, one of said discs including an integral flange portion projecting axially outwardly from said intermediate portion of said one disc on the side thereof opposite the ribs on said intermediate portion, said initially separate rotor support including a tubular body portion, said radially extending confronting edges of said rib portions and said radially extending confronting edges of said rim portions being diffusion bonded together, said discs defining an air passageway therebetween communicating with the radially innermost end of one of said discs and with the periphery of one of said rim portions, said turbine blades each defining air passageways therethrough, said turbine blades being diffusion bonded in angularly spaced relationship to the peripheral surfaces of said discs with the air passageways in said blades communicating with the air passageway defined by said discs, said tubular body portion of said rotor support being diffusion bonded to said flange portion provided on said one disc.

2. A unitary turbine wheel for a gas turbine engine having a turbine shaft, said turbine wheel comprising, in combination, a pair of initially separate metallic discs, a plurality of initially separate metallic turbine blades, and an initially separate metallic rotor support, each of said discs including a hub portion with radially extending side portions, a relatively thin intermediate portion formed integrally with and disposed radially outwardly of said hub portion, and a rim portion formed integrally with and disposed radially outwardly of said intermediate portion, each of said discs also including a plurality of angularly spaced, radially extending rib portions formed integrally with and projecting axially from the inner side of the intermediate portion of each of said discs, ech of said rib portions and each of said rim portions having a radially extending edge, respectively, disposed in axially spaced relationship with respect to the radially extending side portions of said hub portions of said discs, one of said discs including an integral flange portion projecting axially outwardly from said intermediate portion of said one disc on the side thereof opposite the rib portions on said intermediate portion, said initially separate rotor support including a tubular body portion having a plurality of integral, longitudinally spaced ribs projecting radially outwardly therefrom and an integral flange portion projecting radially inwardly from the central section thereof, said radially extending confronting edges of said rib portions and said radially extending confronting edges of said rim portions being diffusion bonded together whereby said discs define air passageways therebetween communicating with the radially innermost end of one of said discs and with the periphery of said one disc, said turbine blades each defining air passageways therethrough, said turbine blades being diffusion bonded in angularly spaced relationship to the peripheral surfaces of said discs with the air passageways in said blades communicating with the air passageways defined by said discs, said rotor support being diffusion bonded to said flange portion provided on said one disc.

* * * * *